US008902118B2

(12) United States Patent
Ryou et al.

(10) Patent No.: US 8,902,118 B2
(45) Date of Patent: Dec. 2, 2014

(54) CRLH-TL META MATERIAL ANTENNA

(75) Inventors: Byung Hoon Ryou, Seoul (KR); Won Mo Sung, Siheung-si (KR); Jeong Keun Jl, Seoul (KR)

(73) Assignee: EMW Co., Ltd., Seoul (KR)

( * ) Notice: Subject to any disclaimer, the term of this patent is extended or adjusted under 35 U.S.C. 154(b) by 825 days.

(21) Appl. No.: 13/129,392

(22) PCT Filed: Nov. 11, 2009

(86) PCT No.: PCT/KR2009/006606

§ 371 (c)(1),
(2), (4) Date: Aug. 5, 2011

(87) PCT Pub. No.: WO2010/056032

PCT Pub. Date: May 20, 2010

(65) Prior Publication Data

US 2011/0285602 A1 Nov. 24, 2011

(30) Foreign Application Priority Data

Nov. 13, 2008 (KR) ..... 10-2008-0112576

(51) Int. Cl.
*H01Q 1/48* (2006.01)

(52) U.S. Cl.
USPC ..... 343/848; 343/876; 343/700 MS

(58) Field of Classification Search
USPC ..... 343/848, 876, 700 MS
See application file for complete search history.

(56) References Cited

U.S. PATENT DOCUMENTS

2008/0048917 A1 2/2008 Achour et al.
2008/0258981 A1 10/2008 Achour et al.
2008/0258993 A1 10/2008 Gummalla et al.

OTHER PUBLICATIONS

Wei Tong, et al., "Dual Composite Right/Left-Handed (D-CRLH) Transmission Line in GaAs MMIC Technology," International Workshop on Antenna Technology, pp. 105-108, (Mar. 21-23, 2007).
PCT International Search Report for PCT Counterpart Application No. PCT/KR2009/006606 containing Communication relating to the Results of the International Search Report, 4 pgs., (Jun. 15, 2010).

*Primary Examiner* — Karl D Frech
(74) *Attorney, Agent, or Firm* — The PL Law Group, PLLC

(57) ABSTRACT

There is provided an antenna having a spiral-shaped loading formed on the ground plane, in which a resonant frequency is lowered as the reactance component of a CRLH-TL structure is adjusted.

7 Claims, 9 Drawing Sheets

CRLH-TL META MATERIAL ANTENNA

CROSS-REFERENCE TO RELATED APPLICATIONS

This patent application is a U.S. National Phase application under 35 U.S.C. §371 of International Application No. PCT/KR2009/006606, filed Nov. 11, 2009, entitled CRLH-TL METAMATERIAL ANTENNA, which claims priority to Korean patent application number 10-2008-0112576, filed Nov. 13, 2008.

TECHNICAL FIELD

The present invention relates to a composite right and left handed transmission line (CRLH-TL) meta material antenna, and more specifically, to a CRLH-TL meta material antenna miniaturized using spiral loadings of a ground plane.

BACKGROUND ART

A meta material structure attracting attention recently in the electromagnetic wave application field shows a peculiar phenomenon that has not been mentioned in the general electromagnetic theory. Since the meta material structure has symbols of diverse group velocities and phase velocities in the dispersion characteristic, propagation of electromagnetic waves is explained in the left-hand propagation law, not in the right-hand propagation law. For example, when an electromagnetic wave propagates through a meta material in a free space, the transverse components of a transmitted wave are reverse to those of an incident wave, and if a right-handed transmission line (RH-TL) is combined with a left-handed transmission line (LH-TL), pass and stop bands are formed to be different from those of only a conventional RH-TL.

SUMMARY

Therefore, the present invention has been made in view of the above problems, and it is an object of the present invention to provide a CRLH-TL meta material antenna miniaturized using spiral loadings of a ground plane.

An antenna according to an embodiment of the present invention is implemented using spiral-shaped loadings on a ground plane, and thus a resonant frequency is lowered as the reactance components of a CRLH-TL stricture are adjusted.

According to the present invention, a miniaturized antenna implemented using spiral-shaped loadings on a ground plane can be provided by obtaining a low resonant frequency as the reactance components of a CRLH-TL stricture are adjusted.

DETAILED DESCRIPTION

A CRLH-TL meta material antenna will be hereafter described in detail, with reference to the accompanying drawings.

Figure 1:
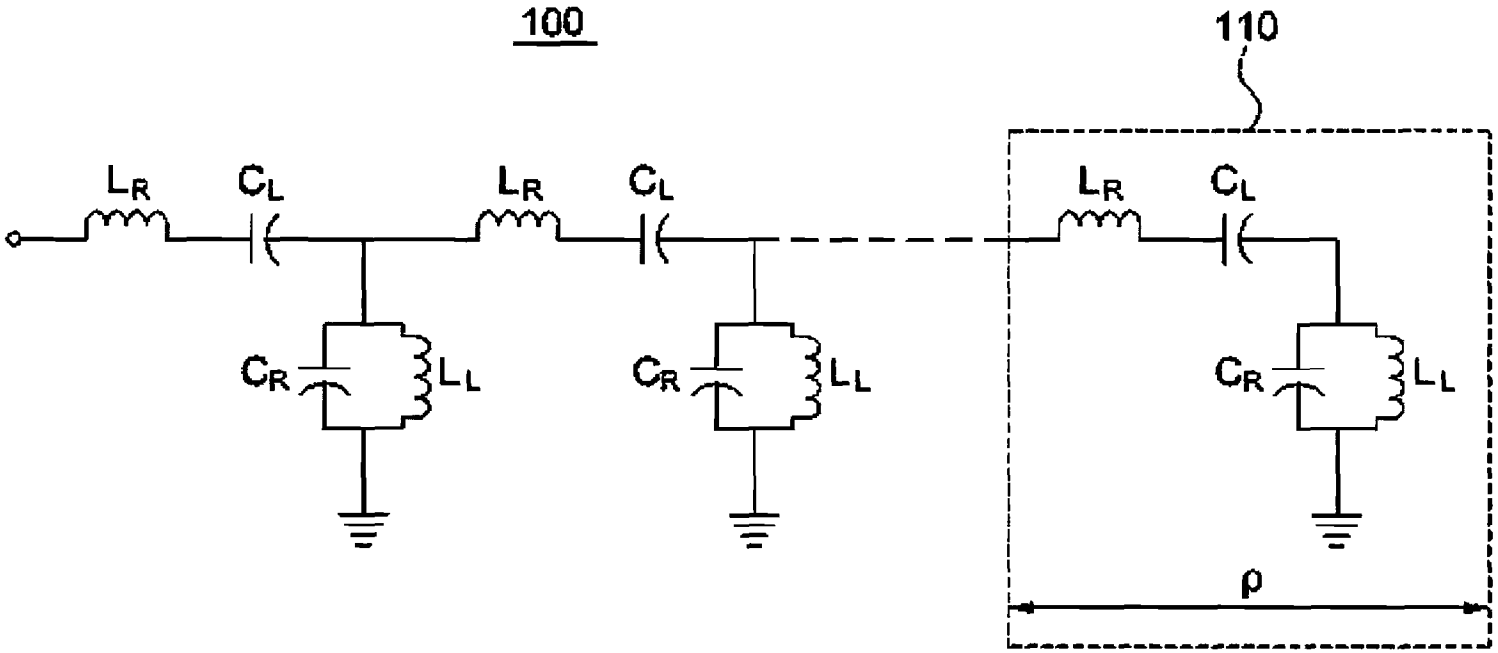
FIG. 1 is a view showing an equivalent circuit and a unit cell of a CRLH-TL structure.

FIG. 1 is a view showing an equivalent circuit and a unit cell of a CRLH-TL structure.

Referring to FIG. 1, the equivalent circuit 100 of a CRLH-TL structure comprises a serial inductor $L_R$, a parallel capacitor $C_R$, a parallel inductor $L_L$, and a serial capacitor $C_L$, and includes a unit cell 110. Here, the serial inductor $L_R$ and the parallel capacitor $C_R$ are shown in order to equalize a circuit of a general structure, and the parallel inductor $L_L$ and the serial capacitor $C_L$ are added to equalize a circuit of the CRLH-TL structure.

The CRLH-TL structure is a typical structure of a meta material applied to an antenna according to the present invention, and this structure has a negative order (−) resonant mode, as well as a positive order (+) resonant mode that can be seen in a conventional antenna.

There is a 0-th order resonant mode where the propagation constant becomes 0 among resonant modes of the CRLH-TL structure. In the 0-th order resonant mode, a wavelength grows to be infinite, and phase delay related to wave transmission does not occur. Since reactance components constituting the CRLH-TL determine a resonant frequency of the 0-th order resonant mode, the resonant frequency is not affected by the length of an antenna, and thus it is advantageous in miniaturizing the antenna.

Since an antenna according to an embodiment of the present invention has spiral-shaped loadings formed on a ground plane, a low resonant frequency is obtained by adjusting the reactance components, and thus the antenna can be miniaturized.

As described above, since the 0-th order resonant frequency is determined by the reactance components, a spiral loading increases inductance of the parallel inductor $L_L$, and thus the 0-th order resonant frequency can be lowered in an antenna according to the present invention.

Figure 2:
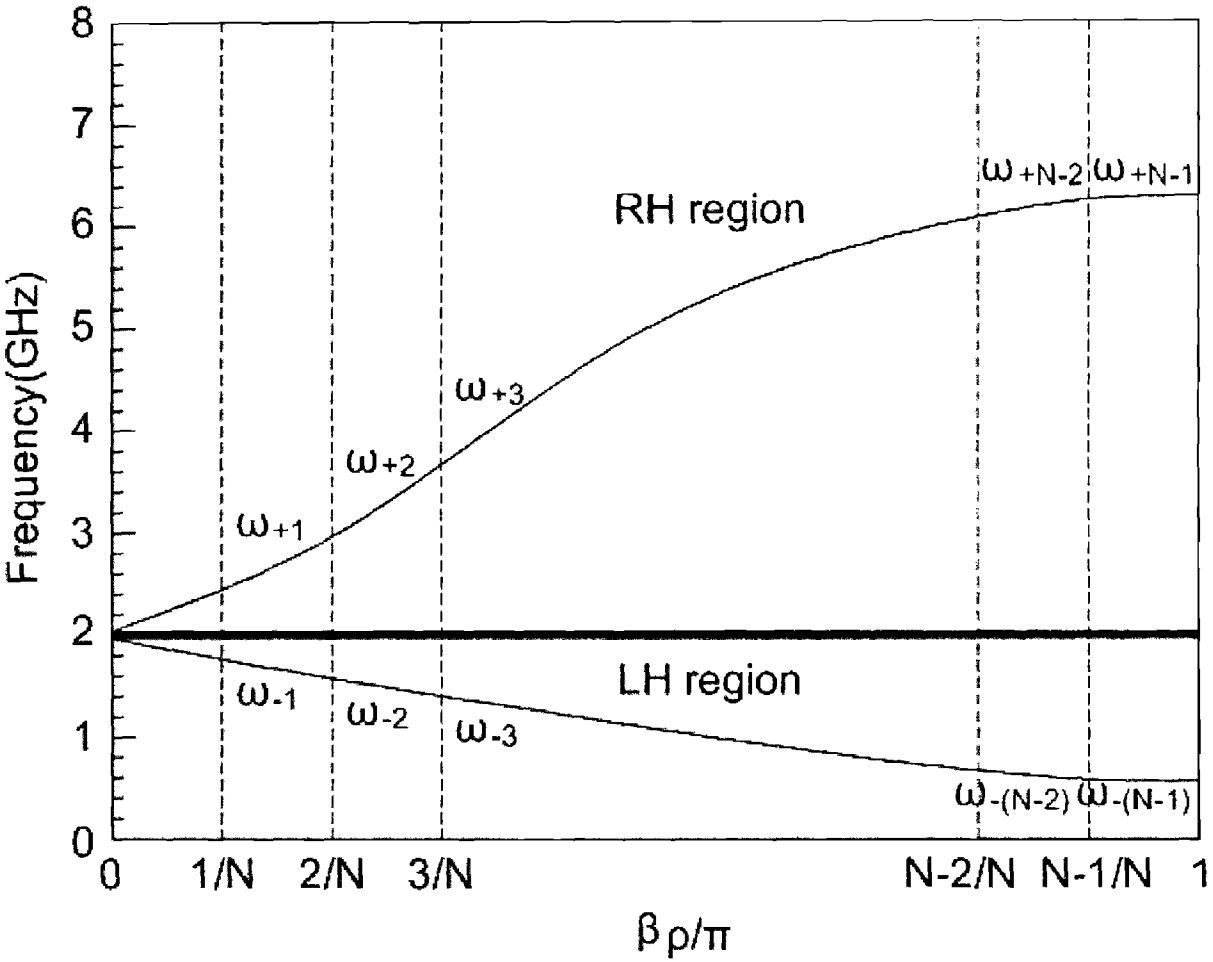
FIG. 2 is a view showing a propagation-constant vs. frequency graph according a circuit of a CRLH-TL structure.

FIG. 2 is a view showing a propagation-constant vs. frequency graph according to a circuit of a CRLH-TL structure.

Referring to FIG. 2, in an antenna using a CRLH-TL structure according to an embodiment of the present invention, the resonant frequency varies depending on RH or LH region, and a 0-th or negative order (−) resonant frequency, as well as a positive order (+) resonant frequency, can be obtained.

Figure 3:
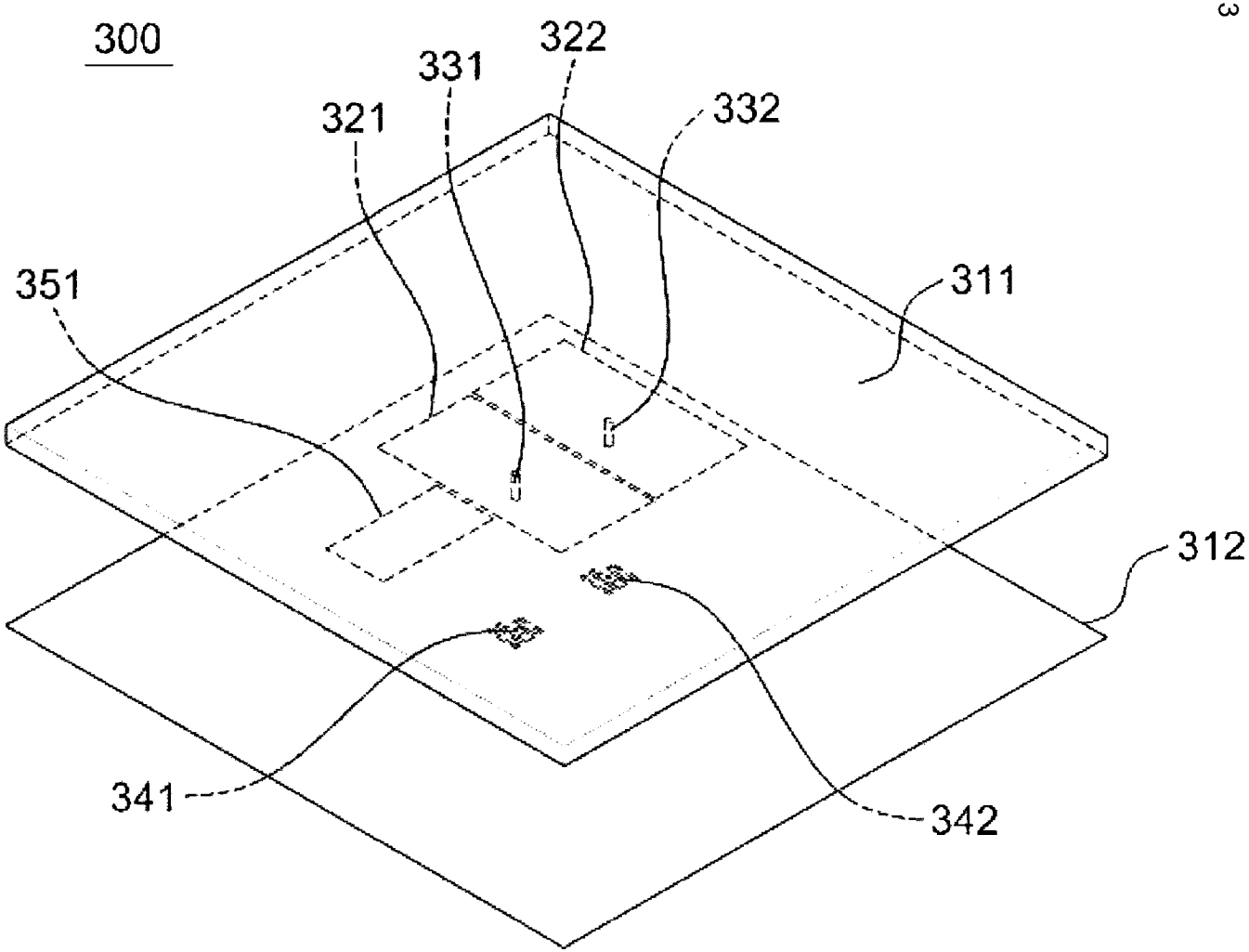
FIG. 3 is a view showing a CRLH-TL antenna configured with two unit cells according to an embodiment of the present invention, in which the CRLH-TL antenna is divided into layers.

FIG. 3 is a view showing a CRLH-TL antenna implemented using two unit cells according to an embodiment of the present invention, in which the CRLH-TL antenna is divided into layers.

Referring to FIG. 3, the CRLH-TL antenna 300 according to an embodiment of the present invention is configured with two unit cells.

For example, in the CRLH-TL antenna 300 according to an embodiment of the present invention, a dielectric substrate having a permittivity of 2.2 and a dimension of 55 mm×55 mm×1.5 mm is placed in the middle, and a power feed line 351 having a width of 8 mm and two patches 321 and 322 having a size of 12.4 mm×25 mm are placed on the upper layer 311.

In addition, in the CRLH-TL antenna 300 according to an embodiment of the present invention, the distance between the patches 321 and 322 is 0.2 mm, and a ground plane on which spiral-shaped slots having a width of 0.2 mm and an interval of 0.2 mm are formed may be placed on the lower layer 312.

In addition, in the CRLH-TL antenna 300 according to an embodiment of the present invention, the patches 321 and 322 of the upper layer can be connected to spiral loadings 341 and 342 of the lower layer through vias 331 and 332 having a radius of 0.2 mm.

Like this, in the CRLH-TL antenna 300 according to an embodiment of the present invention, the spiral loadings are formed as formed as spiral-shaped slots.

Figure 4:
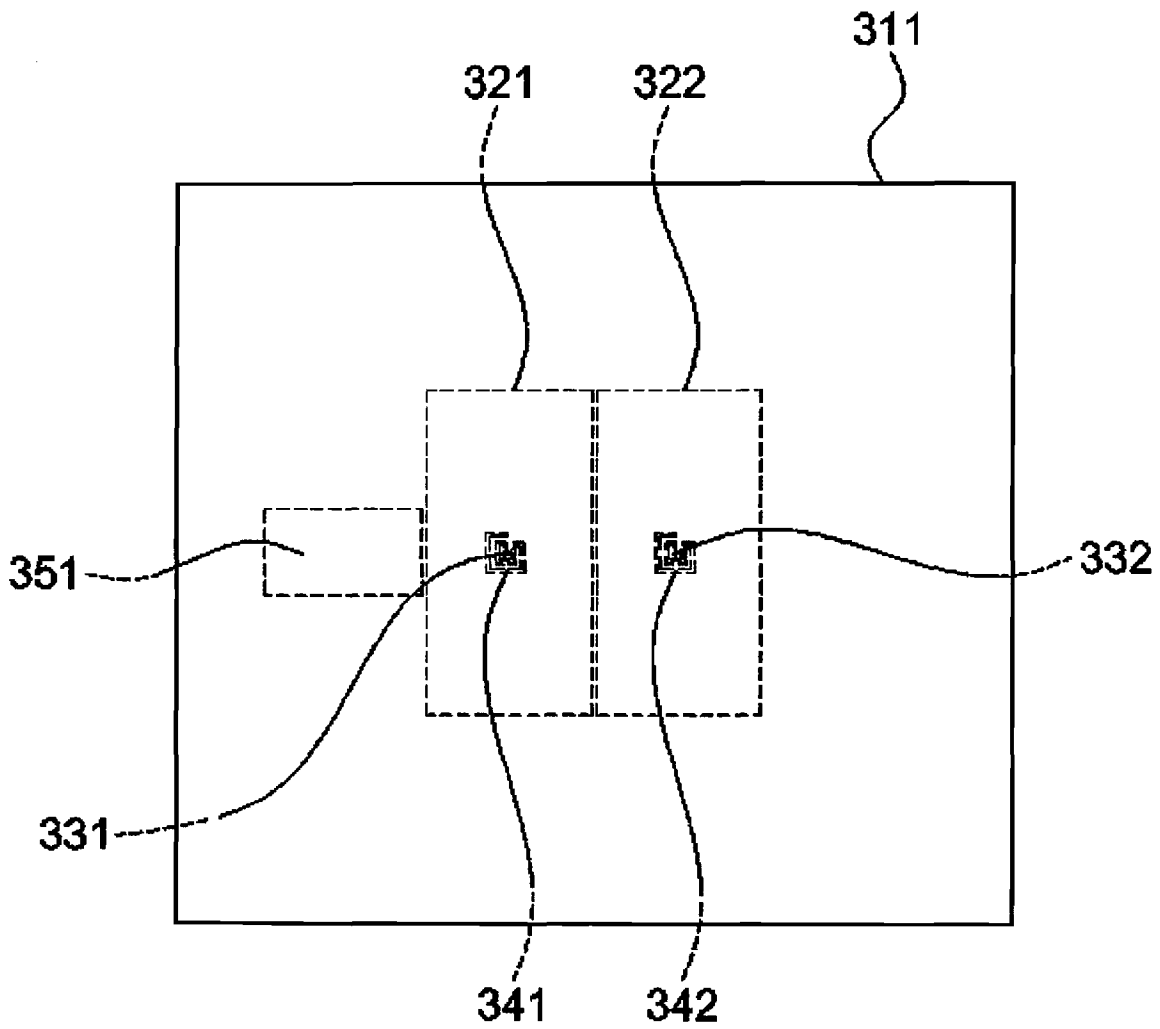
FIG. 4 is a top view of a CRLH-TL antenna configured with two unit cells according to an embodiment of the present invention, in which patches and a power feed line are shown.
Figure 5:
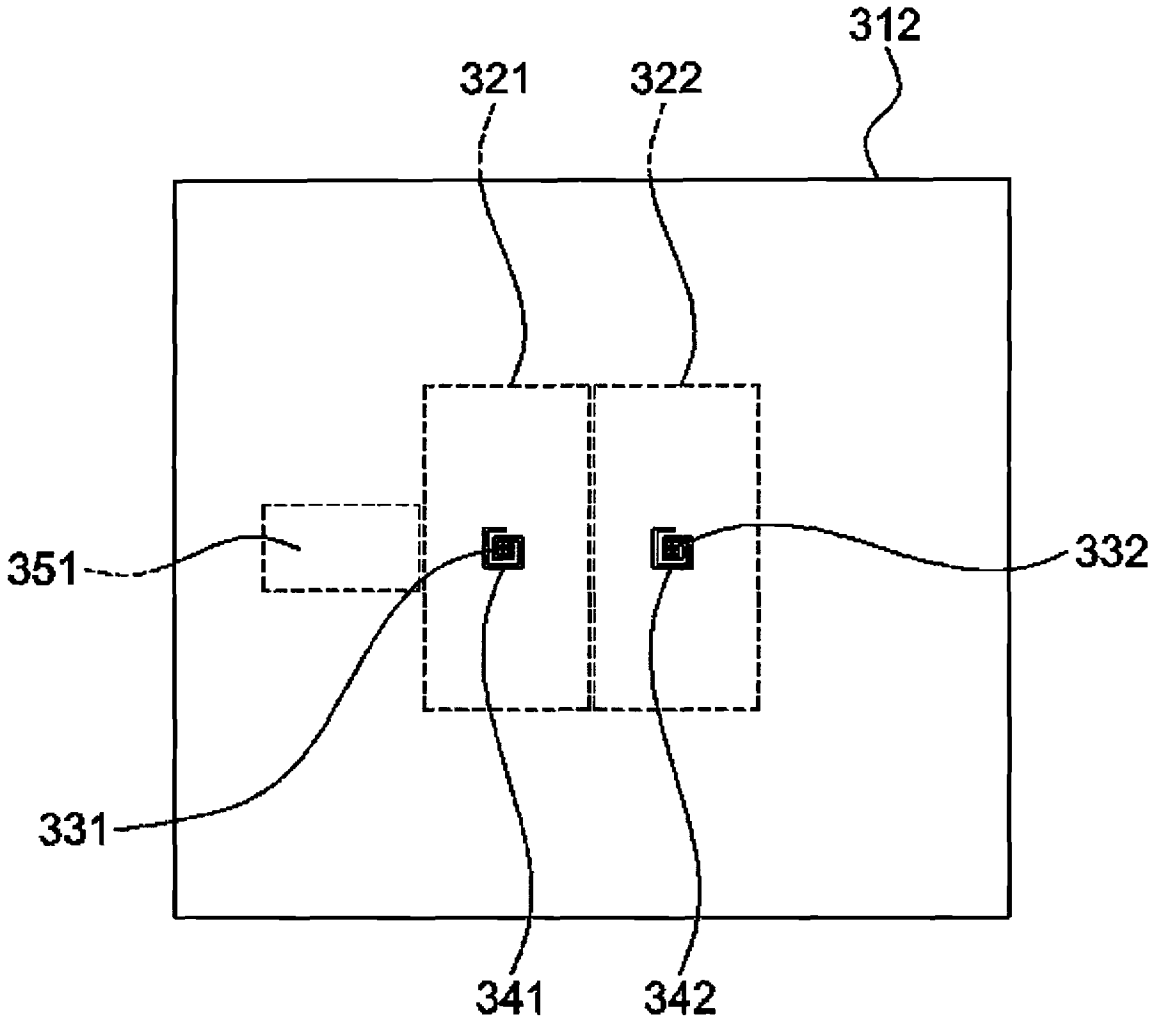
FIG. 5 is a bottom view of a CRLH-TL antenna configured with two unit cells according to an embodiment of the present invention, in which spiral loadings are formed as spiral-shaped slots.

FIG. 4 is a top view of a CRLH-TL antenna configured with two unit cells according to an embodiment of the present invention, in which patches and a power feed line are shown, and FIG. 5 is a bottom view of a CRLH-TL antenna configured with two unit cells according to an embodiment of the present invention, in which spiral loadings are formed as spiral-shaped slots.

Figure 6:
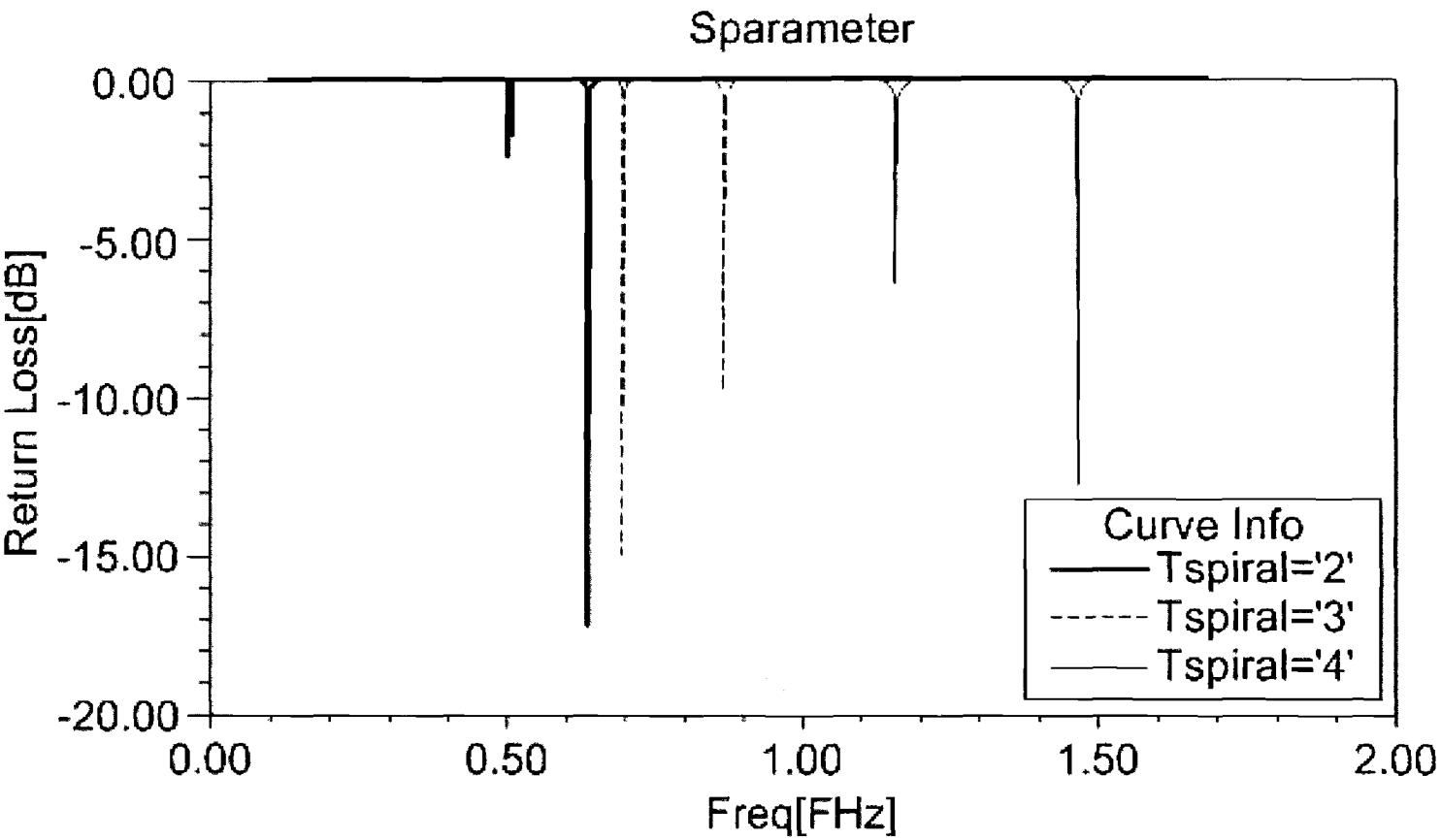
FIG. 6 is a view showing return losses according to the number of turns of spiral when both of spiral loadings of two cells are formed clockwise.

FIG. 6 is a view showing return losses according to the number of turns of spiral when both of spiral loadings of two cells are formed clockwise.

Referring to FIG. 6, in the antenna according to an embodiment of the present invention, both of the spiral loadings of the two unit cells are formed in the same clockwise direction, and it is understood that a −1-th order resonant frequency and a 0-th order resonant frequency are lowered as the number of turns of spiral is increased for each of the spiral loadings.

Figure 7:
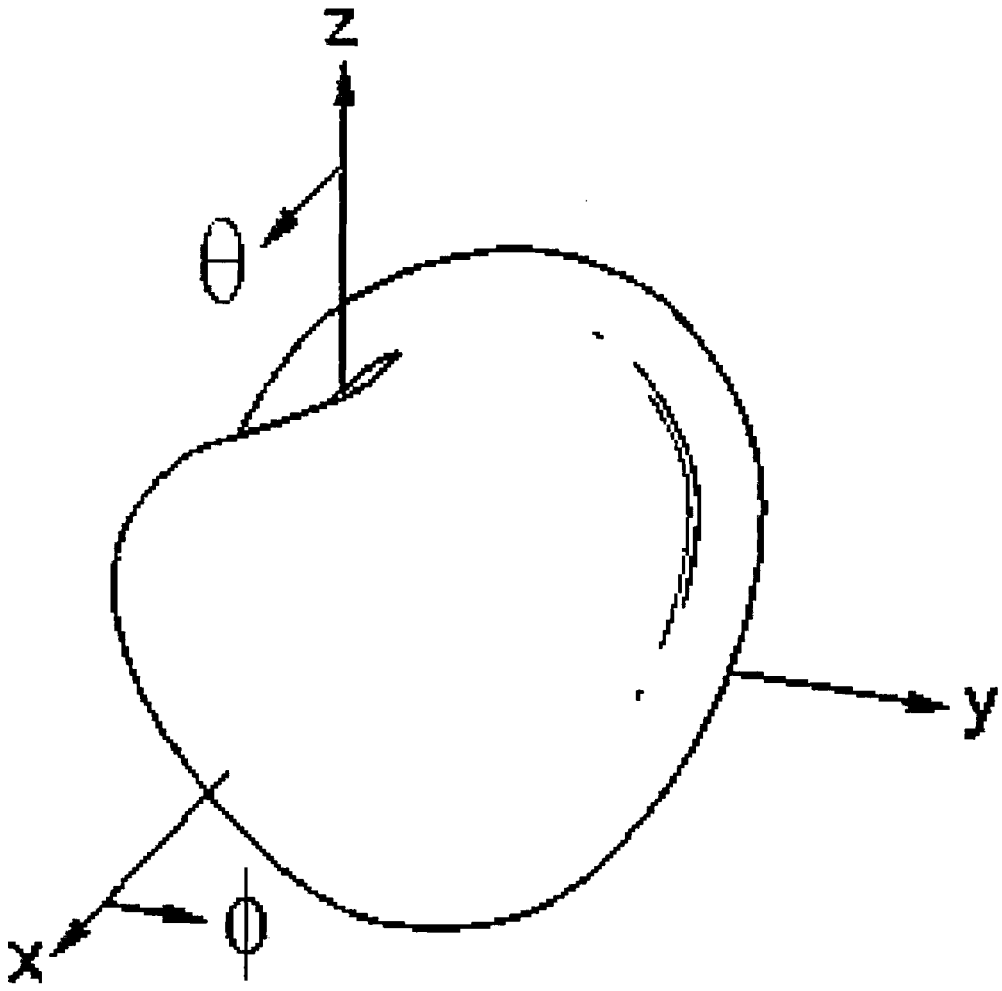
FIG. 7 is a view showing a gain distribution or a radiation pattern of a 0-th order resonant frequency when the number of turns is three in FIG. 6.

FIG. 7 is a view showing a gain distribution or a radiation pattern of a 0-th order resonant frequency when the number of turns is three in FIG. 6.

In the antenna according to an embodiment of the present invention, if the number of turns of spiral is three at the spiral loading of a unit cell as shown in FIG. 6, the maximum gain for the 0-th order resonant frequency may be 0.03 dBi.

Figure 8:
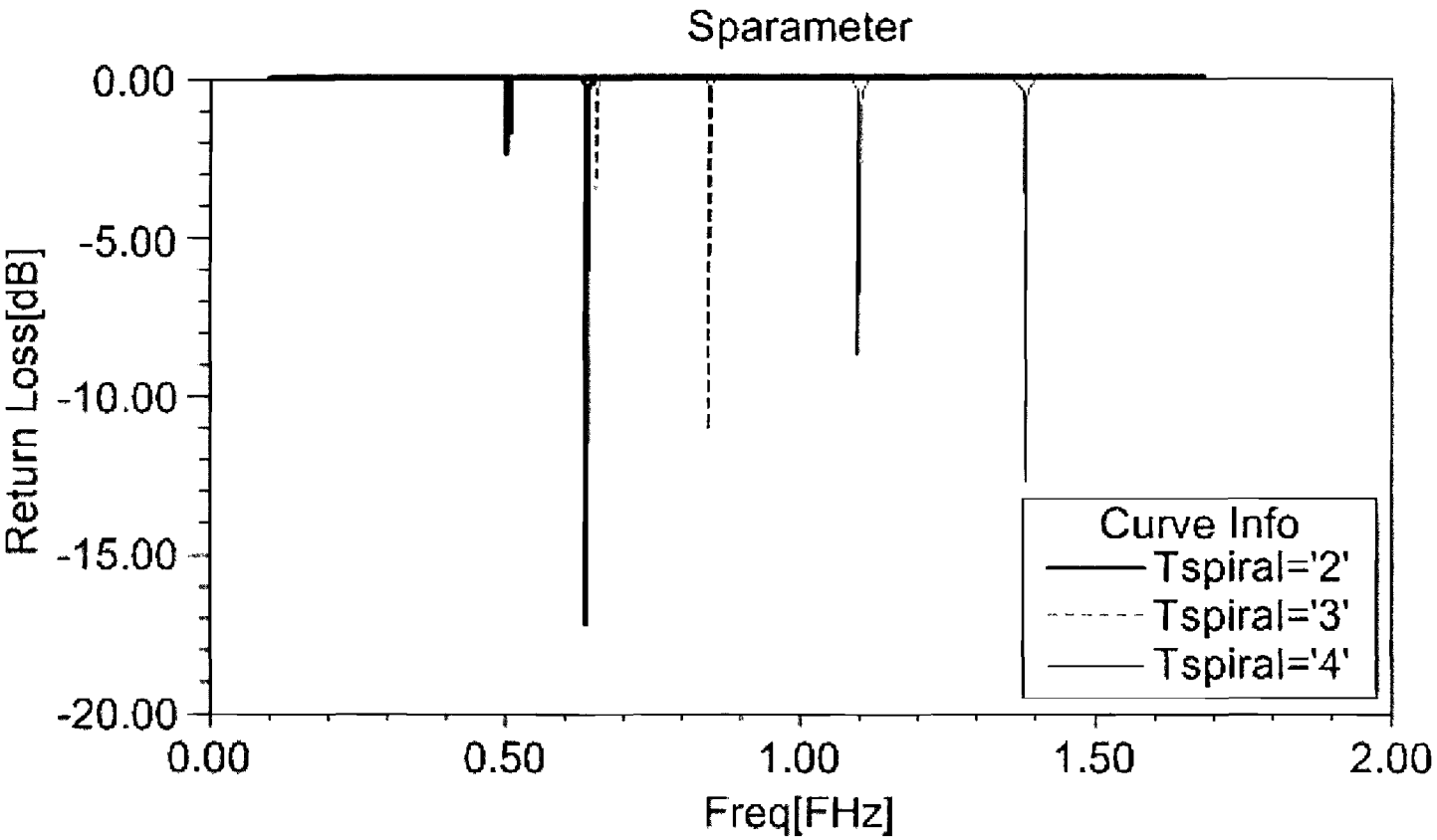
FIG. 8 is a view showing return losses according to the number of turns of spiral when spiral loadings of two cells are formed to face each other.

FIG. 8 is a view showing return losses according to the number of turns of spiral when spiral loadings of two cells are formed to face each other.

Referring to FIG. 8, in the antenna according to an embodiment of the present invention, the spiral loadings of the first and second cells of the two unit cells are respectively formed clockwise and counterclockwise to face each other, and it is understood that the −1-th order resonant frequency and the 0-th order resonant frequency are lowered as the number of turns increases for each of the spiral loadings.

Figure 9:
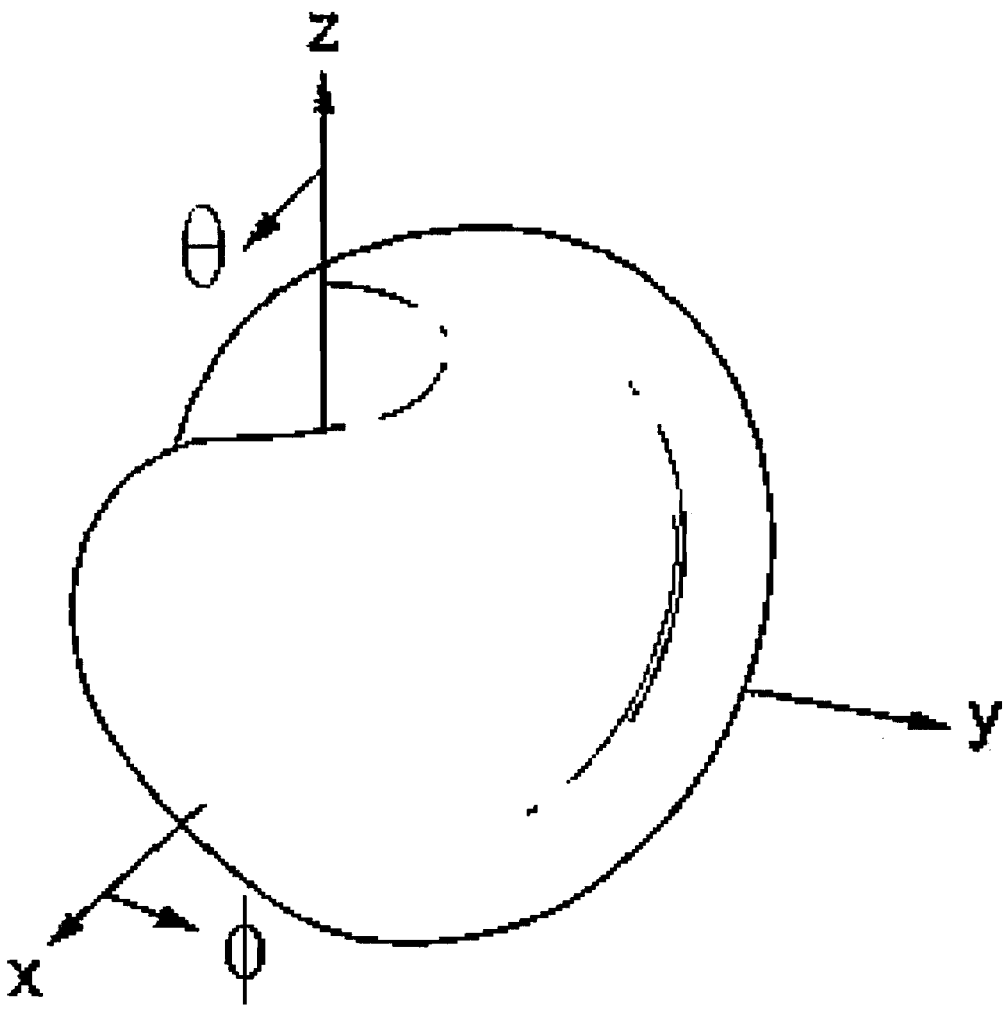
FIG. 9 is a view showing a gain distribution or a radiation pattern of a 0-th order resonant frequency when the number of turns is three in FIG. 8.

FIG. 9 is a view showing a gain distribution or a radiation pattern of a 0-th order resonant frequency when the number of turns is three in FIG. 8.

In the antenna according to an embodiment of the present invention, if the number of turns of spiral is three at the spiral loading of a unit cell as shown in FIG. 8, the maximum gain for the 0-th order resonant frequency may be −1.75 dBi.

In addition, in the antenna according to an embodiment of the present invention, a user may obtain desired antenna performance depending on changes in the number of unit cells, the sizes of a patch, a via, and a dielectric substrate, the width, interval, direction, and number of turns of the spiral loading, the position and method of power feeding, and the like.

Like this, in the antenna according to an embodiment of the present invention, spiral-shaped loadings are formed on the ground plane, and the reactance components of the CRLH-TL structure are adjusted. Therefore, a low 0-th order resonant frequency or a negative order resonant frequency is obtained regardless of the length of the antenna, and thus miniaturization of the antennas can be accomplished.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An antenna having a spiral-shaped loading formed on a ground plane, for lowering a resonant frequency by adjusting reactance components of a CRLH-TL structure, wherein the spiral loading is formed as a spiral-shaped slot.

2. The antenna according to claim 1, wherein the spiral loading lowers a 0-th order resonant frequency if inductance of a parallel inductor $L_L$ is increased in the CRLH-TL structure.

3. The antenna according to claim 1, wherein the resonant frequency is lowered as the number of turns of spiral is increased.

4. The antenna according to claim 3, wherein if the spiral loading is configured with two cells and both of the two cells are formed clockwise, a −1-th order resonant frequency and a 0-th order resonant frequency are lowered as the number of turns of spiral is increased.

5. The antenna according to claim 3, wherein if the spiral loading is configured with two cells respectively formed clockwise and counterclockwise to face each other, a −1-th order resonant frequency and a 0-th order resonant frequency are lowered as the number of turns of spiral is increased.

6. The antenna according to claim 1, wherein performance is adjusted depending on changes in the number of unit cells and sizes of a patch, a via, and a dielectric substrate constructing the spiral loading, and a width, an interval, and a direction of the spiral loading, and a position and method of feeding power to the spiral loading.

7. The antenna according to claim 6, wherein the dielectric substrate is placed in a middle, a power feed line and two patches are placed on an upper layer, the patches on the upper layer is connected to the spiral loadings on a lower layer through the vias, and the ground plane where the spiral-shaped slots are formed is placed on the lower layer.

* * * * *